US005351772A

United States Patent [19]

Smith

[11] Patent Number: 5,351,772

[45] Date of Patent: Oct. 4, 1994

[54] POLYCRYSTALLINE DIAMOND CUTTING ELEMENT

[75] Inventor: Redd H. Smith, Salt Lake City, Utah

[73] Assignee: Baker Hughes, Incorporated, Houston, Tex.

[21] Appl. No.: 16,085

[22] Filed: Feb. 10, 1993

[51] Int. Cl.[5] ..... E21B 10/46

[52] U.S. Cl. ..... 175/428; 51/293; 175/432

[58] Field of Search ..... 175/426, 428, 430, 432, 175/433, 444; 76/108.2; 407/118, 119; 51/293, 295

[56] References Cited

U.S. PATENT DOCUMENTS

| | | | |
|---|---|---|---|
| 4,109,737 | 8/1978 | Bovenkerk | 175/430 |
| 4,525,179 | 6/1985 | Gigl | 51/309 |
| 4,629,373 | 12/1989 | Hall | 407/118 |
| 4,784,023 | 11/1988 | Dennis | 76/108.2 |
| 4,858,707 | 8/1989 | Jones et al. | 175/431 |
| 4,872,520 | 10/1989 | Nelson | 175/430 |
| 4,954,139 | 9/1990 | Cerutti | 51/293 |
| 4,984,642 | 1/1991 | Renard et al. | 175/430 |
| 4,997,049 | 3/1991 | Tank et al. | 175/430 |
| 5,007,207 | 4/1991 | Phaal | 175/432 X |
| 5,011,515 | 4/1991 | Frushour | 51/307 |
| 5,025,874 | 6/1991 | Barr | 175/430 |
| 5,037,451 | 8/1991 | Burnhard et al. | 51/293 |
| 5,054,246 | 10/1991 | Phaal et al. | 51/204 |
| 5,120,327 | 6/1992 | Dennis | 51/293 |
| 5,172,778 | 12/1992 | Tibbitts | 175/420.1 |
| 5,217,081 | 6/1993 | Waldenström | 175/420.2 |

FOREIGN PATENT DOCUMENTS 0322214 6/1992 European Pat. Off. .

*Primary Examiner*—David J. Bagnell
*Attorney, Agent, or Firm*—Trask, Britt & Rossa

[57] ABSTRACT

A substantially polycrystalline diamond compact cutting element for drilling subterranean formations. The cutting element includes a cemented carbide substrate having radially extending raised lands on one side thereof, to and over which is formed and bonded a polycrystalline diamond table.

24 Claims, 4 Drawing Sheets

Fig. 13A
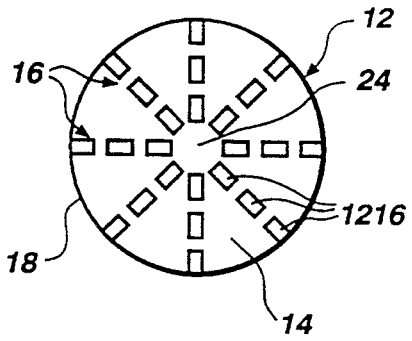
Fig. 13B
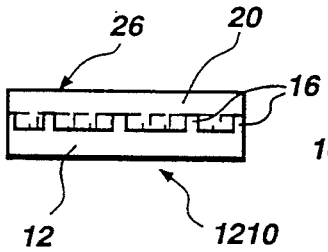
Fig. 13C
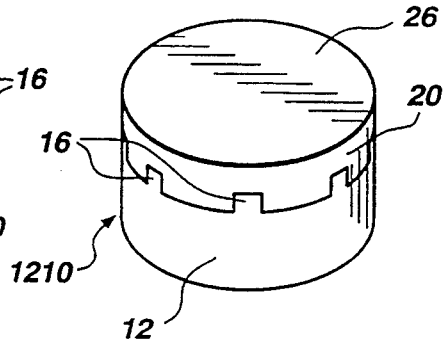
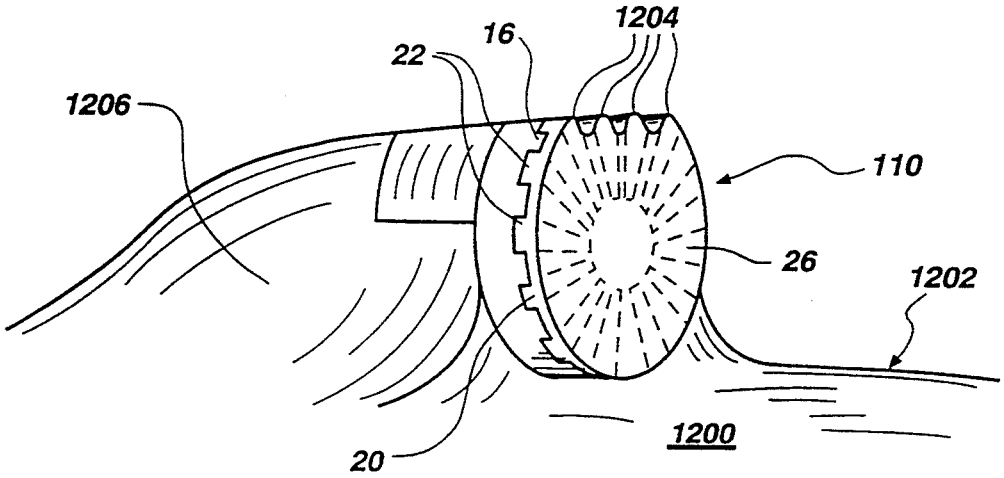
Fig. 14

POLYCRYSTALLINE DIAMOND CUTTING ELEMENT

BACKGROUND

1. Field of the Invention

The present invention relates generally to superhard cutting elements, and more specifically to substantially planar polycrystalline diamond compact cutting elements comprising a polycrystalline diamond table formed and bonded to a supporting substrate during formation of the cutting element.

2State of the Art

Polycrystalline diamond compact cutting elements, commonly known as PDC's, have been commercially available for over twenty years. PDC's may be self-supporting, or may comprise a substantially planar diamond table bonded during formation to a supporting substrate. The diamond table/substrate cutting element structure is formed by stacking in a receptacle layers of fine diamond crystals (100 microns or less) and metal catalyst powder, alternating with wafer-like metal substrates of cemented carbide. In some cases, the catalyst o material may be incorporated in the substrate in addition to or in lieu of using a powdered catalyst intermixed with the diamond crystals. The loaded receptacle is subsequently placed in an ultrahigh temperature (typically 1450°–1600° C.), ultrahigh pressure (typically 50–70 kilobar) diamond press wherein the diamond crystals, stimulated by the catalytic effect of the metal powder, bond to each other and to the substrate material. The spaces in the diamond table between the diamond to diamond bonds are filled with residual metal catalyst. A so-called thermally stable PDC product (commonly termed a TSP) may be formed by leaching out the metal in the diamond table. Alternatively, silicon, which possesses a coefficient of thermal expansion similar to that of diamond, may be used to bond diamond particles to produce a Si-bonded TSP. TSP's are capable of enduring higher temperatures (on the order of 1200° C.) without degradation, in comparison to normal PDC's, which experience thermal degradation upon exposure to temperatures of about 750°–800° C.

While PDC and TSP cutting elements employed in rotary drag bits for earth boring have achieved major advances in obtainable rate of penetration and in greatly expanding the types of formations suitable for drilling with diamond bits at economically viable cost, the diamond table/substrate configuration of state of the art planar cutting elements leave something to be desired.

First, the interface of the diamond table with the substrate (typically tungsten carbide, or WC) is subject to high residual shear stresses arising from formation of the cutting element, as after cooling the differing coefficients of thermal expansion of the diamond and substrate material result in thermally-induced stresses. In addition, finite element analysis (FEA) has demonstrated that high tensile stresses exist in a localized region in the outer cylindrical substrate surface and internally in the WC substrate. Both of these phenomena are deleterious to the life of the cutting element during drilling operations, as the stresses, when augmented by stresses attributable to the loading of the cutting element by the formation, may cause spalling, fracture or even delamination of the diamond table from the substrate.

In addition to the foregoing shortcomings, state of the art PDC's often lack sufficient diamond volume to cut highly abrasive formations, as the thickness of the diamond table is limited due to the inability of a relatively thick diamond table to adequately bond to the substrate.

Finally, the benefits of a multi-thickness diamond table, which produces a kerfing action during drilling as the thickness portions, have been recognized. However, all such prior art PDC configurations (see, for example, U.S. Pat. Nos. 4,784,023 and 5,120,327) employ parallel linear interleaved ridges of diamond and substrate extending across the cutting element. Such a configuration, which is purported by the patentee to alleviate the diamond table/substrate interface stresses, may actually by its asymmetrical nature, aggravate rather than alleviate and undesirably concentrate such stresses, as well as substrate outer surface stresses. In fact, the embodiment of the '327 patent, wherein a circumferential ring of diamond is formed around the substrate ridges to resist crack formation and propagation in the substrate, is a tacit admission of the basic parallel ridge structure's inability to remedy the basic interface stress problem.

Another PDC cutting element structure which affords a multiple-depth diamond table is disclosed in European Patent Specification Publication No. 0 322 214 B1. This structure's substrate ridges resemble a "bull's eye" pattern in one embodiment, and a spiral pattern in another. While allegedly providing curved cutting ridges as the cutting element wears, wear of such ridges causes the primary contact points between the cutting element and the formation to migrate rapidly laterally, so that a deep kerf or cleft in the formation at a substantially constant radial location is never effected.

SUMMARY OF THE INVENTION

In contrast to the prior art, the cutting element of the present invention comprises a substantially planar structure of circular cross section comprising a PDC diamond table bonded to a WC substrate having lands thereon spaced about the perimeter of the substrate. The diamond table depth exceeds the height of the substrate lands so that an all-diamond cutting surface is presented.

In a preferred embodiment, the substrate lands are substantially symmetrically spaced and extend radially from a position proximate to the center of the substrate toward the perimeter. The lands may or may not extend to the very center of the substrate, and may or may not reach the outer edge of the substrate. The lands may increase in height from the center of the substrate to the periphery, decrease in height, or increase and then decrease in height, or vice versa. Similarly, the lands may increase or decrease in width as they extend from the substrate center to the periphery. The lands may be of square, rectangular, triangular, arcuate, or other suitable cross-section. The substrate interface surface itself (aside from the lands) may be convex or concave. The lands may be linear, or arcuate. More than one of the foregoing features may be combined in a single structure.

The radial land configuration at the diamond table/-substrate interface is believed to redistribute the interface stresses, reduce their areas of concentration, as well as reducing outer surface stresses in the substrate by correlating the radially symmetric stress fields and radially symmetric substrate lands and interposed diamond material. Stated another way, the radial land configuration of the present invention provides the ability to redistribute the stress field in a more favorable way. FEA demonstrates that the continuous circumferential tensile stress field normally present around the periphery of a PDC substrate is modified in all three dimensions and the stress field continuity interrupted when the present invention is employed, which phenomenon tends to prevent cracks originating on the periphery of the substrate from propagating across the field and delaminating the diamond table. Moreover, FEA demonstrates that the present invention also separates the discontinuous tensile stress concentration with areas of high compressive stress, the latter serving as crack arrestors. The lands enhance the diamond table/substrate bond by increasing surface area and resistance to impact and shear forces, and the increased diamond volume provided by the deeper diamond table provides enhanced wear characteristics for cutting highly abrasive formations. The lands permit and in fact promote the use of a thicker diamond table with reduced risk of spalling or fracture of the table. Similarly, the multi-thickness diamond table produced by the diamond extending between the lands provides a kerfing action against the formation being drilled as the cutting element wears.

BRIEF DESCRIPTION OF THE DRAWINGS

FIGS. 13A, 13B and 13C are, respectively, a top elevation of a substrate employed in a thirteenth embodiment of a PDC cutting element according to the present invention, a side view of that cutting element embodiment, and a perspective view of another example of that cutting element embodiment employing a thicker substrate; and FIG. 14 is a perspective view of a partially worn cutting element according to the present invention shown mounted on the face of a drill bit.

DETAILED DESCRIPTION OF THE EMBODIMENTS OF THE INVENTION

Figure 1A:
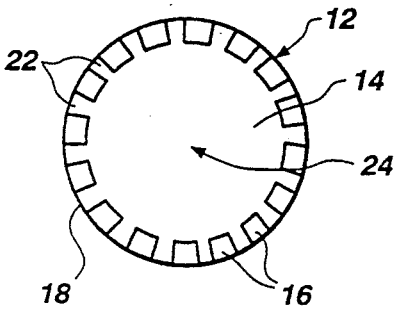
FIGS. 1A, 1B and 1C are, respectively, a top elevation of a substrate employed in a first embodiment of a PDC cutting element according to the present invention, a side view of that cutting element embodiment, and a perspective view of another example of that cutting element embodiment employing a thicker substrate.
Figure 1B:
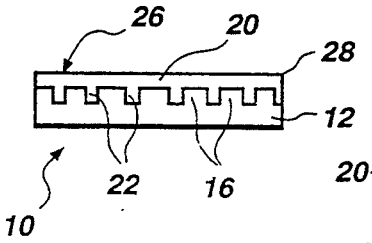
Figure 1C:
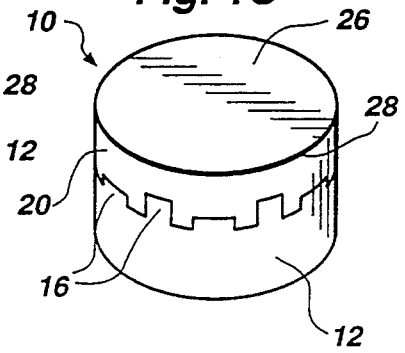

Referring FIGS. 1A–1C of the drawings, a first embodiment of the cutting element 10 of the present invention is depicted. FIG. 1A shows, looking down from above, a rounded cemented carbide substrate 12 having a substantially planar surface 14 on which a plurality of lands 16 are spaced in abutting relationship to the periphery 18 of substrate 12. FIG. 1B depicts a cutting element 10 with PDC diamond table 20 formed on and bonded to substrate 12, lands 16 projecting upwardly into diamond table 20 and diamond table 20 extending downwardly into channels 22 between lands 16. Lands 16 in this embodiment of the invention are of square or rectangular cross section and are substantially equal in size and substantially equally spaced above the periphery 18 of substrate 12. As depicted in FIG. 1C, however, lands may be of unequal height and width, and alternate in such characteristics. It should finally be noted that lands 16 are relatively short or truncated in their radial dimension, and extend only a short distance toward the center 24 of substrate 12. As also shown in FIGS. 1B and 1C, the thickness of substrate 12 may vary greatly and does not affect the invention. The cutting surface 26 of diamond table 20 is depicted in FIGS. 1B and 1C as planar with a sharp edge or corner 28, but it should be recognized that chamfered or rounded edges are also contemplated as being a feature of cutting elements of the present invention. Diamond table 20 is shown to be of exaggerated thickness, for clarity, in all of the drawing figures.

FIGS. 2–13 depict additional embodiments of the present invention, and features therein corresponding to those of FIGS. 1A–1C will be identified with like reference numerals for the sake of clarity.

Figure 2A:
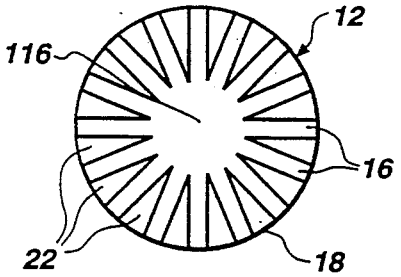
FIGS. 2A, 2B and 2C are, respectively, a top elevation of a substrate employed in a second embodiment of a PDC cutting element according to the present invention, a side view of that cutting element embodiment, and a perspective view of another example of that cutting element embodiment employing a thicker substrate.
Figure 2B:
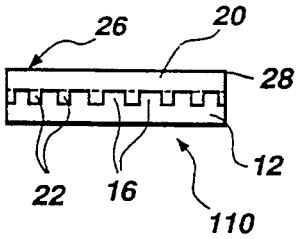
Figure 2C:
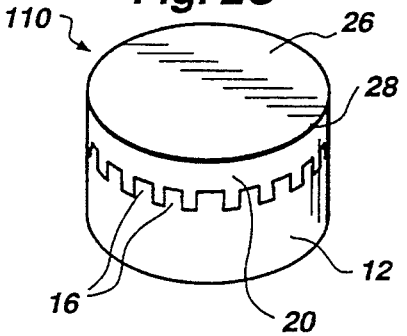

The cutting element embodiment 110 of FIGS. 2A–2C employs a plurality of elongated lands 16 extending radially from the periphery 18 of a substrate 12, and its planar surface comprises a plurality of separated, wedge-shaped behind channels 22. As with the first embodiment, lands 16 abut periphery 18 but unlike the first embodiment, extend inwardly to form a solid core land 116 at their juncture. As with the embodiment of FIGS. 1A–1C, the lands 16 may be of various heights and widths.

Figure 3A:
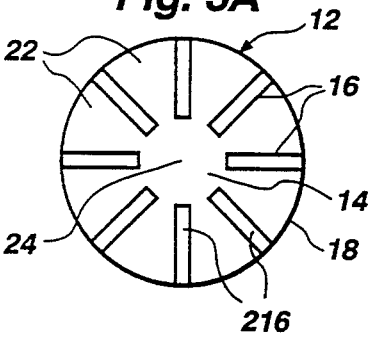
FIGS. 3A, 3B and 3C are, respectively, a top elevation of a substrate employed in a third embodiment of a PDC cutting element according to the present invention, a side view of that cutting element embodiment, and a perspective view of another example of that cutting element embodiment employing a thicker substrate.
Figure 3B:
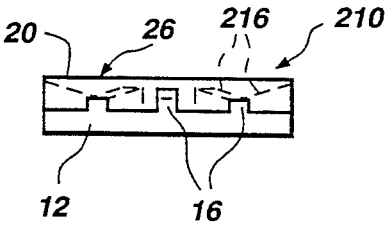
Figure 3C:
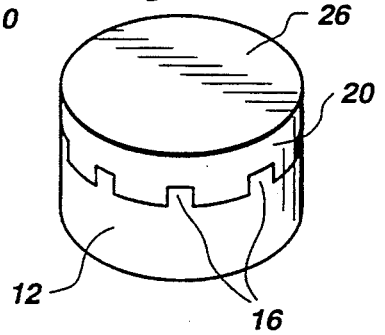

FIGS. 3A–3C depict a third embodiment 210 of the cutting element of the present invention, wherein elongated lands 16 extend radially from an area near the center 24 of substrate 12 to the periphery thereof, channels 22 being open to the center 24. Lands 16 may be of uniform height and width, or vary. Lands 16 may also have top surfaces 216 parallel to substrate surface 14, or surfaces 216 may slope toward or away from center 24, or alternate in their slope as depicted in FIG. 3B.

Figure 4A:
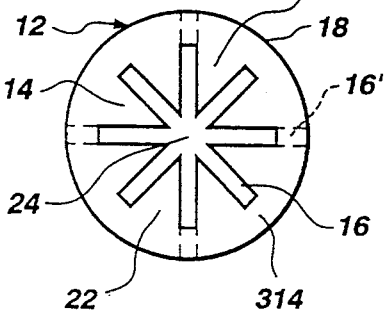
FIGS. 4A, 4B and 4C are, respectively, a top elevation of a substrate employed in a fourth embodiment of a PDC cutting element according to the present invention, a side view of that cutting element embodiment, and a perspective view of another example of that cutting element embodiment employing a thicker substrate.
Figure 4B:
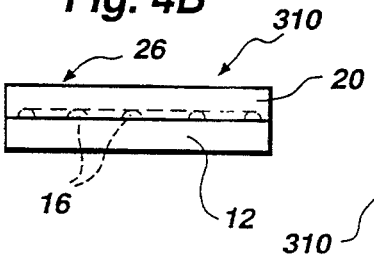
Figure 4C:
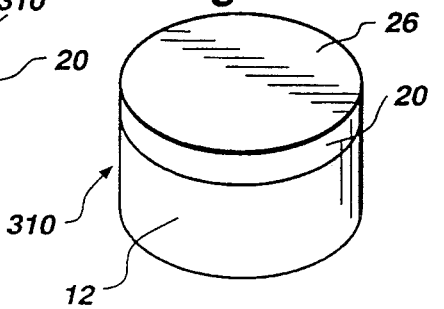

FIGS. 4A–4C depict a fourth embodiment 310 of the cutting element of the invention, cutting element 310 having elongated lands 16 joined at the center 24 of substrate 12 but removed from the periphery 18, blind channels 22 all communicating with substrate surface 14 in peripheral zone 314. As shown in broken lines, some lands 16 may extend to the periphery 18 of substrate 12 while alternating lands 16 are removed therefrom. As is clearly illustrated in FIG. 4B, land 16 may have a half-circular or other arcuately-bounded cross section. As with the previously described embodiments, lands 16 may vary in height, width and slope, and may be of rectangular cross section instead of arcuate.

Figure 5A:
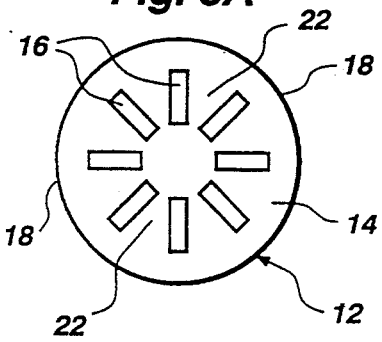
FIGS. 5A, 5B and 5C are, respectively, a top elevation of a substrate employed in a fifth embodiment of a PDC cutting element according to the present invention, a side view of that cutting element embodiment, and a perspective view of another example of that cutting element embodiment employing a thicker substrate.
Figure 5B:
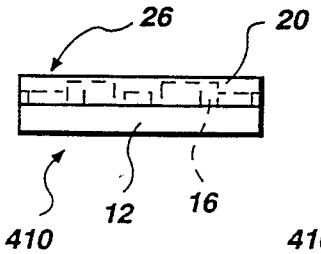
Figure 5C:
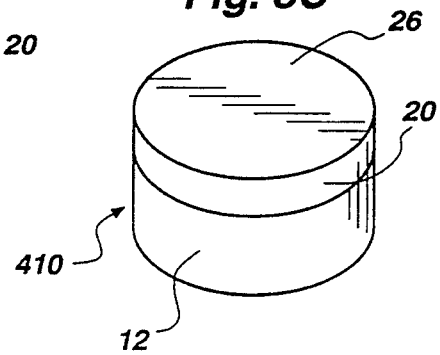

FIGS. 5A–5C depict a cutting element embodiment 410 which is similar to that of FIGS. 3A–3C except that lands 16 extend neither to the center 24 nor the periphery of substrate 12. As depicted in FIG. 5B, the heights of alternating lands may vary, as may the width, slope, cross-sectional configuration and length.

Figure 6A:
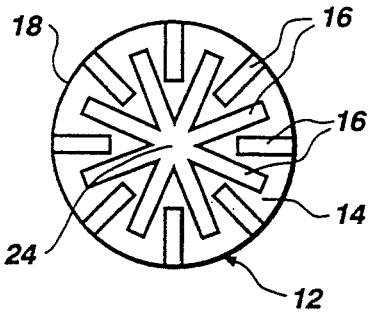
FIGS. 6A, 6B and 6C are, respectively, a top elevation of a substrate employed in a sixth embodiment of a PDC cutting element according to the present invention, a side view of that cutting element embodiment, and a perspective view of another example of that cutting element embodiment employing a thicker substrate.
Figure 6B:
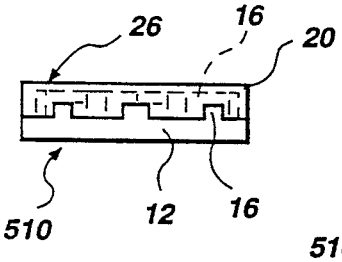
Figure 6C:
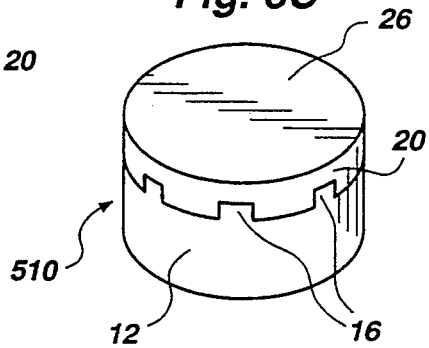

FIGS. 6A–6C depict a cutting element 510 which may be generally described as a combination of the embodiment of FIGS. 3 with that of FIGS. 4. Two sets of interleaved lands 16 are employed, one set abutting the periphery 18 of substrate 12, and extending radially inwardly therefrom, and the other emanating radially from the center 24 but terminating short of periphery 18. The lands may vary in width, height, slope and cross section, and one set of lands may have one common set of characteristics, such as height, while the other set may differ in that same characteristic (see FIG. 6B).

Figure 7A:
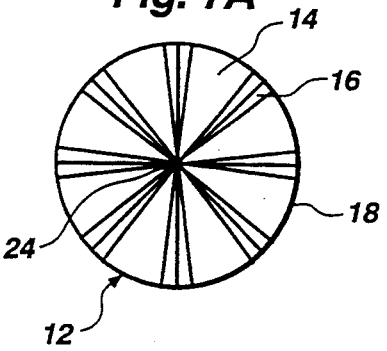
FIGS. 7A, 7B and 7C are, respectively, a top elevation of a substrate employed in a seventh embodiment of a PDC cutting element according to the present invention, a side view of that cutting element embodiment, and a perspective view of another example of that cutting element embodiment employing a thicker substrate.
Figure 7B:
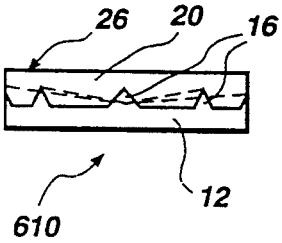
Figure 7C:
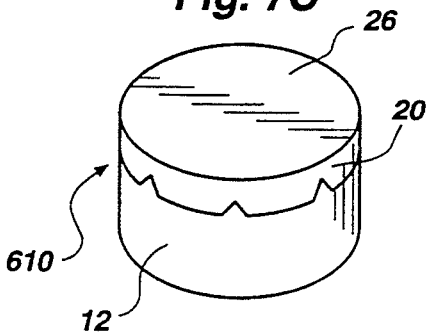

FIGS. 7A–7C depict yet another embodiment 610 of the cutting element of the invention, lands 16 in this embodiment are of triangular cross section and increase in height from the center 24 of substrate 12 to the periphery 18 thereof.

Figure 8A:
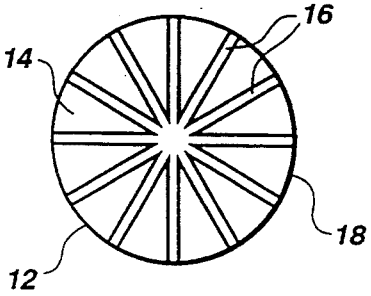
FIGS. 8A, 8B and 8C are, respectively, a top elevation of a substrate employed in an eighth embodiment of a PDC cutting element according to the present invention, a side view of that cutting element embodiment, and a perspective view of another example of that cutting element embodiment employing a thicker substrate.
Figure 8B:
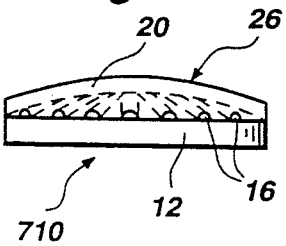
Figure 8C:
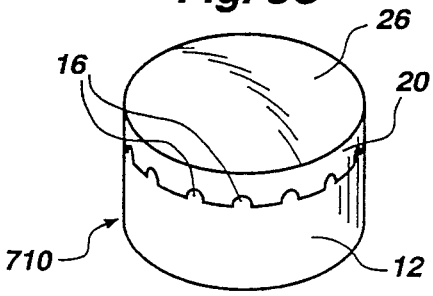

FIGS. 8A–8C depict a cutting element 710 wherein the substrate 12 has a convex surface 614 to which diamond table 20 is formed, and lands 16, of arcuate cross section extend from center 24 to periphery 18 of substrate 12. It should also be noted that diamond table 20 is itself arcuate, or convex, in configuration, following the contour of substrate surface 614.

Figure 9A:
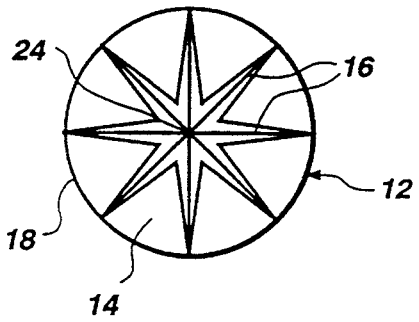
FIGS. 9A, 9B and 9C are, respectively, a top elevation of a substrate employed in a ninth embodiment of a PDC cutting element according to the present invention, a side view of that cutting element embodiment, and a perspective view of another example of that cutting element embodiment employing a thicker substrate.
Figure 9B:
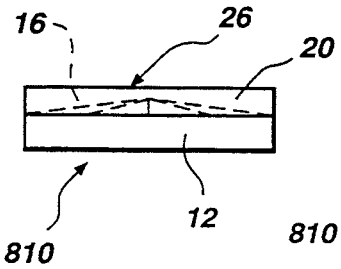
Figure 9C:
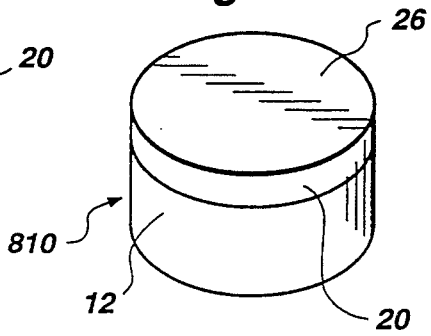

FIGS. 9A–9C show another cutting element configuration 810 wherein lands 16, of triangular cross section, decrease in height from center 24 to periphery 18 of substrate 12.

Figure 10A:
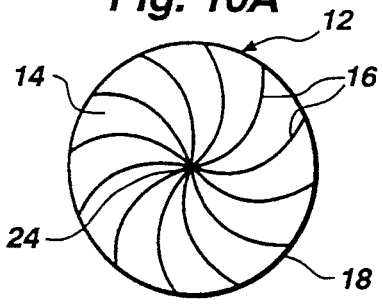
FIGS. 10A, 10B and 10C are, respectively, a top elevation of a substrate employed in a tenth embodiment of a PDC cutting element according to the present invention, a side view of that cutting element embodiment, and a perspective view of another example of that cutting element embodiment employing a thicker substrate.
Figure 10B:
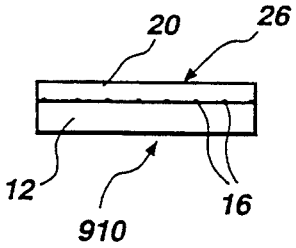
Figure 10C:
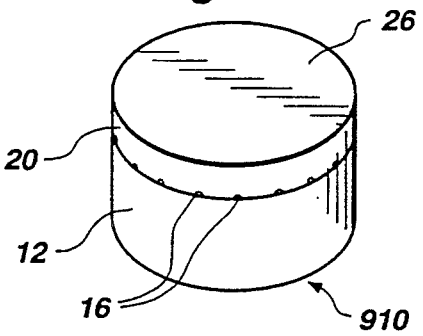

FIGS. 10A–10C show a cutting element 910 having spiral-landed substrate 12, wherein each land 16 extends from the center 24 of substrate 12 in an arcuate path to the perimeter 18. As illustrated, the lands 16 are of uniform height, width, length and cross-sectional configuration, but such characteristics may in fact be varied.

Figure 11A:
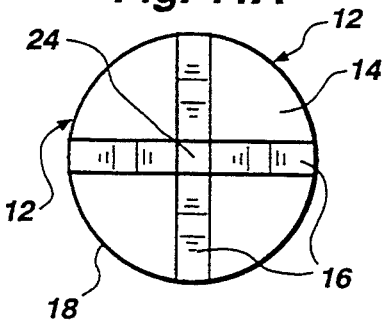
FIGS. 11A, 11B and 11C are, respectively, a top elevation of a substrate employed in an eleventh embodiment of a PDC cutting element according to the present invention, a side view of that cutting element embodiment, and a perspective view of another example of that cutting element embodiment employing a thicker substrate.
Figure 11B:
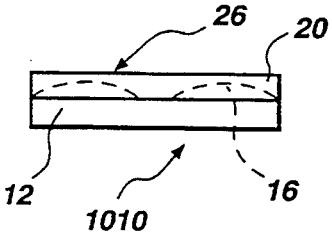
Figure 11C:
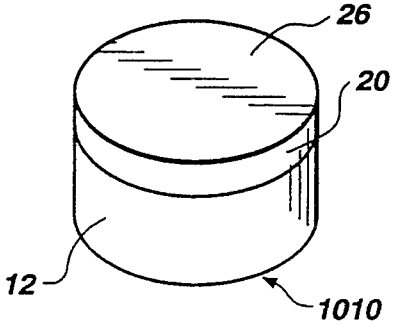

FIGS. 11A–11C depict yet another embodiment 1010 at the present invention, cutting element 1010 having lands 16 which increase and then decrease in height as they extend radially from proximate to the center 24 to the periphery 18 of substrate 12.

Figure 12A:
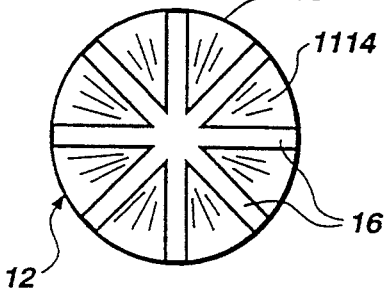
FIGS. 12A, 12B and 12C are, respectively, a top elevation of a substrate employed in a twelfth embodiment of a PDC cutting element according to the present invention, a side view of that cutting element embodiment, and a perspective view of another example of that cutting element embodiment employing a thicker substrate.
Figure 12B:
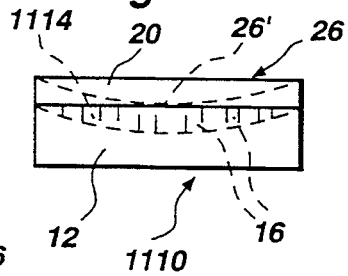
Figure 12C:
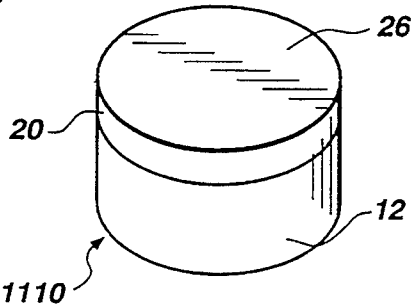

FIGS. 12A–12C show a cutting element embodiment 1110 having a substrate 12 with a concave surface 1114 to which diamond table 20 is formed, lands 16 extending from the periphery 18 to the center 24 of substrate 12 with a constant level upper surface and thereby a steadily increasing height as the center 24 of substrate 12 is approached. As shown in FIG. 12B, the cutting element 26 of the diamond table 20 may be flat, or may comprise a concave surface 26.

FIGS. 13A–13C show a cutting element embodiment 1210 having a substrate 12 having lands 16 which are comprised of radially discontinuous sub-lands 1216. It is also contemplated that each set of sub-lands 1216 lying on the same radius may be rotationally offset from the adjacent set.

FIG. 14 depicts the embodiment 110 of FIGS. 2A–2C mounted on the face 1202 of drill bit 1200, and illustrates the kerfing or scribing structure 1204 achieved by the inter-land increased diamond table thickness in channels 22 of the present invention as the cutting element wears. While the cutting element 110 has been shown in FIG. 14 mounted directly to the bit face 1202 and buttressed by matrix material 1206, it will be understood that it may or any of the other embodiments may be secured to a stud or other carrier element known in the art, the cutting structure there being secured to the bit face via the carrier element.

It should further be noted that, in contrast to the kerfing type cutting elements of the prior art, the cutting elements of the present invention need not be rotationally oriented to a specific position prior to affixation to a carrier structure or directly to the face of the drill bit, as shown in FIG. 14. The prior art cutting elements, with their parallel lands extending across the substrate must be specifically oriented so that the lands are generally perpendicular to the bit face to achieve a kerfing effect. Moreover, the non-radial orientation of the prior art lands is believed to aggravate the stress concentrations associated with the substrate/diamond table interface, resulting in a less robust, less impact-resistant structure than the present invention.

It will be appreciated by one of ordinary skill in the art that one or more features of the illustrated embodiments may be combined with one or more features from another to form yet another combination within the scope of the invention as described and claimed herein. Further, while the substrate structures have been illustrated and described as being uniform or symmetrical as to features of the lands and the substrate surface, the invention is not so limited. Moreover, the features of the present invention may be employed in half-round, quarter-round, or even "tombstone" shaped cutting elements to great advantage, and the shape of the cutting surface and the configuration of the cutting surface edge or edges of the diamond table may be varied as desired without diminishing the advantages or utility of the invention. Finally, it is contemplated that the invention may be applicable to cutting elements having polycrystalline cubic boron nitride cutting tables.

What is claimed is:

1. A cutting element for use on a rotary drag bit for drilling subterranean formations, said cutting element comprising:

a substrate having at least one substantially planar side and an arcuate perimeter comprising at least a segment of a circle, and further including a plurality of upwardly-projecting lands located on said at least one substantially planar side adjacent the perimeter of said substrate, said lands extending radially inwardly from said arcuate perimeter toward the location of the center of said circular segment; and a table comprising polycrystalline superhard material bonded to said substrate on said at least one substantially planar side thereof, extending between said lands and having a depth greater than the height of said upwardly-projecting lands.

2. The cutting element of claim 1, wherein said superhard material table comprises a polycrystalline diamond compact.

3. The cutting element of claim 2, wherein said polycrystalline diamond compact comprises a thermally stable product.

4. The cutting element of claim 1, wherein said lands are substantially evenly spaced about said perimeter of said substrate.

5. The cutting element of claim 1, wherein said substrate includes said center location, and said lands extend radially inwardly from said perimeter thereto.

6. The cutting element of claim 5, wherein said perimeter comprises a half-circle.

7. The cutting element of claim 5, wherein said perimeter comprises a circle.

8. The cutting element of claim 5, wherein said lands are spaced radially inwardly from said substrate perimeter.

9. The cutting element of claim 5, wherein said lands abut said substrate perimeter.

10. The cutting element of claim 1, wherein said lands are spaced radially inwardly from said substrate perimeter.

11. The cutting element of claim 1, wherein said lands abut said substrate perimeter.

12. The cutting element of claim 1, wherein at least some of said lands decrease in height as they increase in distance from said substrate perimeter.

13. The cutting element of claim 1, wherein at least some of said lands increase in height as they increase in distance from said substrate perimeter.

14. The cutting element of claim 1, wherein said lands decrease in width as they increase in distance from said substrate perimeter.

15. The cutting element of claim 1, wherein said lands increase in width as they increase in distance from said perimeter.

16. The cutting element of claim 1, wherein said lands vary in cross-sectional configuration between said perimeter and said center of said substrate.

17. The cutting element of claim 1, wherein at least some of said lands comprise discontinuous sub-lands.

18. The cutting element of claim 1, wherein said lands are of rectangular cross section.

19. The cutting element of claim 1, wherein said lands are of arcuate cross section.

20. The cutting element of claim 1, wherein said lands abut said substrate perimeter.

21. The cutting element of claim 1, wherein said lands are spaced inwardly from said substrate perimeter.

22. A cutting element for use on a rotary drag bit for drilling subterranean formations, said cutting element comprising:

a substrate having at least one substantially planar side and a perimeter, and further including a plurality of upwardly-projecting lands located on said at least one substantially planar side adjacent the perimeter of said substrate wherein said lands meet proximate the center of said substrate; and a table comprising polycrystalline superhard material bonded to said substrate on said at least one substantially planar side thereof, extending between said lands and having a depth greater than the height of said upwardly-projecting lands.

23. A cutting element for use on a rotary drag bit for drilling subterranean formations, said cutting element comprising:

a substrate having at least one substantially planar side and a perimeter, and further including a plurality of upwardly-projecting lands located on said at least one substantially planar side adjacent the perimeter of said substrate wherein said substantially planar substrate side is convex; and a table comprising polycrystalline superhard material bonded to said substrate on said at least one substantially planar side thereof, extending between said lands and having a depth greater than the height of said upwardly-projecting lands.

24. A cutting element for use on a rotary drag bit for drilling subterranean formations, said cutting element comprising:

a substrate having at least one substantially planar side and a perimeter, and further including a plurality of upwardly-projecting lands located on said at least one substantially planar side adjacent the perimeter of said substrate wherein said substantially planar substrate side is concave; and a table comprising polycrystalline superhard material bonded to said substrate on said at least one substantially planar side thereof, extending between said lands and having a depth greater than the height of said upwardly-projecting lands.

* * * * *